US009707669B2

(12) United States Patent
Liang et al.

(10) Patent No.: US 9,707,669 B2
(45) Date of Patent: Jul. 18, 2017

(54) MOTORS WITH MAGNETIC COMPONENTS

(71) Applicant: Shining Golden Yida Welding & Cutting Machinery Manufacture, Ltd., Hong Kong (HK)

(72) Inventors: Davey Z. Liang, Rancho Santa Fe, CA (US); Daniel S. Cox, Gibsonville, NC (US)

(73) Assignee: Shining Golden Yida Welding & Cutting Machinery Manufacture, LTD., Tsimshatsui, Kowloon (HK)

( * ) Notice: Subject to any disclaimer, the term of this patent is extended or adjusted under 35 U.S.C. 154(b) by 623 days.

(21) Appl. No.: 14/261,290

(22) Filed: Apr. 24, 2014

(65) Prior Publication Data

US 2014/0318820 A1 Oct. 30, 2014

Related U.S. Application Data

(60) Provisional application No. 61/815,721, filed on Apr. 24, 2013.

(51) Int. Cl.
*B25D 9/06* (2006.01)
*B25B 21/02* (2006.01)

(52) U.S. Cl.
CPC ..... *B25B 21/026* (2013.01)

(58) Field of Classification Search
CPC ..... B25D 9/06; B25D 17/00
USPC ..... 227/130, 131
See application file for complete search history.

(56) References Cited

U.S. PATENT DOCUMENTS 6,491,111 B1 12/2002 Livingston
6,662,990 B1 * 12/2003 Sun ..... B25C 1/06 173/210
8,079,504 B1 * 12/2011 Pedicini ..... B25C 1/04 227/130

* cited by examiner

*Primary Examiner* — Andrew M Tecco
(74) *Attorney, Agent, or Firm* — Philip H. Burrus, IV

(57) ABSTRACT

Disclosed are methods and devices utilizing magnetized components to assist operation of an internal mechanism of a tool. Magnetic fields can assist a power tool comprising internal mechanisms that cycle very quickly. Magnetized components can assist in a load/reset action relative to internal components of the power tool. In one example, one or more hammers of a hammer drill/driver can be reset more efficiently when various magnetized elements are oriented in certain ways relative to one another. Additionally, friction between components can be reduced by repulsive magnetic fields between two or more components. Utilizing the magnetic fields can improve the overall function of internal components of the tool. In another example, a tool such as a nailer or stapler can utilize magnetism to assist its internal components. In a nailer or stapler the magnetism can assist, for example, acceleration and deceleration of components utilized to drive the nail/staple.

19 Claims, 9 Drawing Sheets

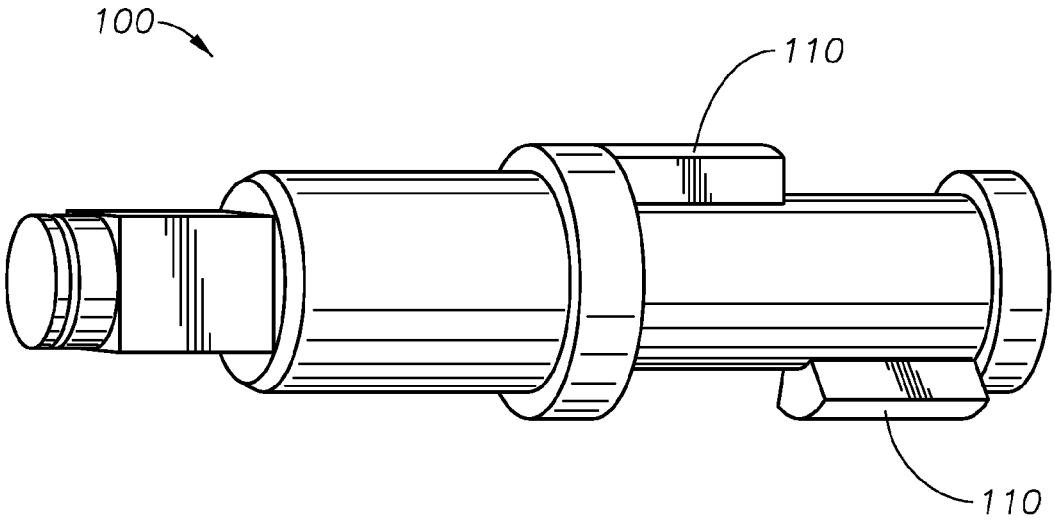
FIG. 1
FIG. 2
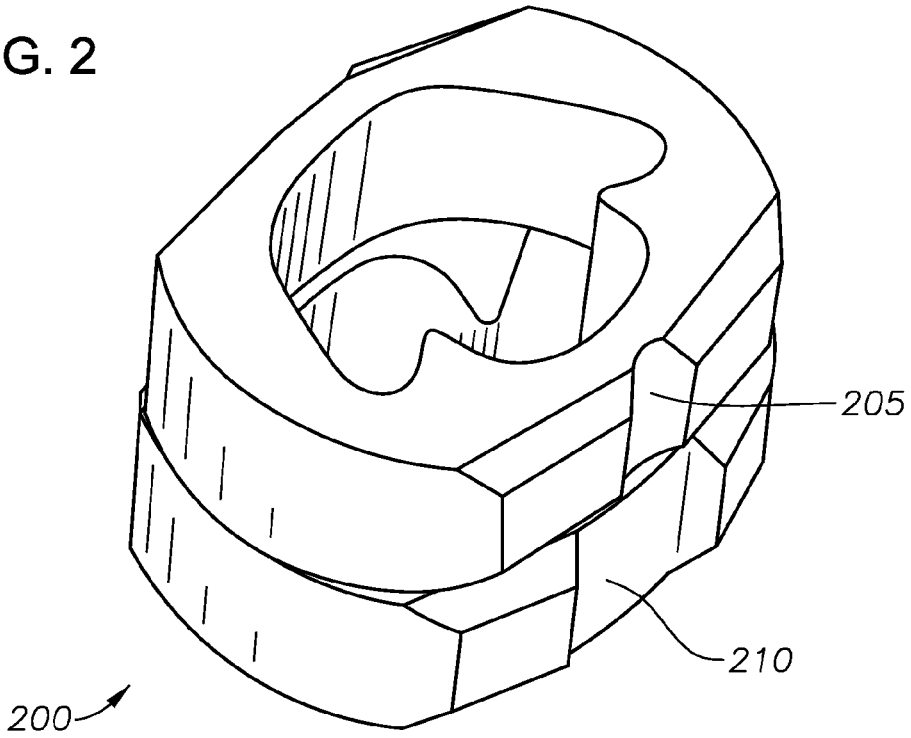

MOTORS WITH MAGNETIC COMPONENTS

CROSS-REFERENCE TO RELATED APPLICATIONS

This application claims the benefit of U.S. Provisional Application No. 61/815,721, filed Apr. 24, 2013, entitled AIR MOTORS WITH MAGNETIC COMPONENTS by the same inventors, which is incorporated by reference herein.

STATEMENT REGARDING FEDERALLY SPONSORED RESEARCH

Not applicable.

BACKGROUND OF THE INVENTION

Field of the Invention

This invention relates to utilizing magnetic components to assist motors driving a hammer chamber with one or two hammers. More particularly, but not by way of limitation, this disclosure relates to improved designs to assist pneumatic motors or air motors having magnetic hammer components.

Description of the Related Art

Pneumatic motors or air motors, though widely used for hand tools and other applications, suffer from certain disadvantages. One disadvantage is that friction reduces the amount of torque or power that can be generated by the motor and causes wear on moving parts. In the case of air motors having a hammer assembly, another disadvantage is that many misfires of the hammers occur due to the hammers not being in strike-ready position at the proper time, which in turn limits the amount of torque generated, as described below. Another disadvantage is that the size of air compressor needed to supply adequate air flow so as to generate sufficient torque is larger than that normally had by individual consumer users. In general, it would be beneficial to increase the amount of torque generated by air tools, all other things being equal. In a similar manner electric motors can suffer some of the same inefficiencies. Accordingly, there is a need for improvements that address these issues.

BRIEF DESCRIPTION OF THE DRAWINGS

It being understood that the figures presented herein should not be deemed to limit or define the subject matter claimed herein, the applicants' invention may be understood by reference to the following description taken in conjunction with the accompanying drawings, in which like reference numerals identify like elements, and in which:

FIG. 1 is a perspective view of a drive shaft configured with two anvils, according to some embodiments.

FIG. 2 is a perspective view of two hammers, according to some embodiments.

DETAILED DESCRIPTION OF SPECIFIC EMBODIMENTS

While various embodiments are described herein, it should be appreciated that the present invention encompasses many inventive concepts that may be embodied in a wide variety of contexts. Thus, the following detailed description of exemplary embodiments, read in conjunction with the accompanying drawings, is merely illustrative, and neither the description nor the drawings are not to be taken as limiting the scope of the invention. Rather, the scope of the invention is defined by the appended claims and equivalents thereof.

Illustrative embodiments of the invention are described below. In the interest of clarity, not all features of an actual implementation are described in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

Figure 11:
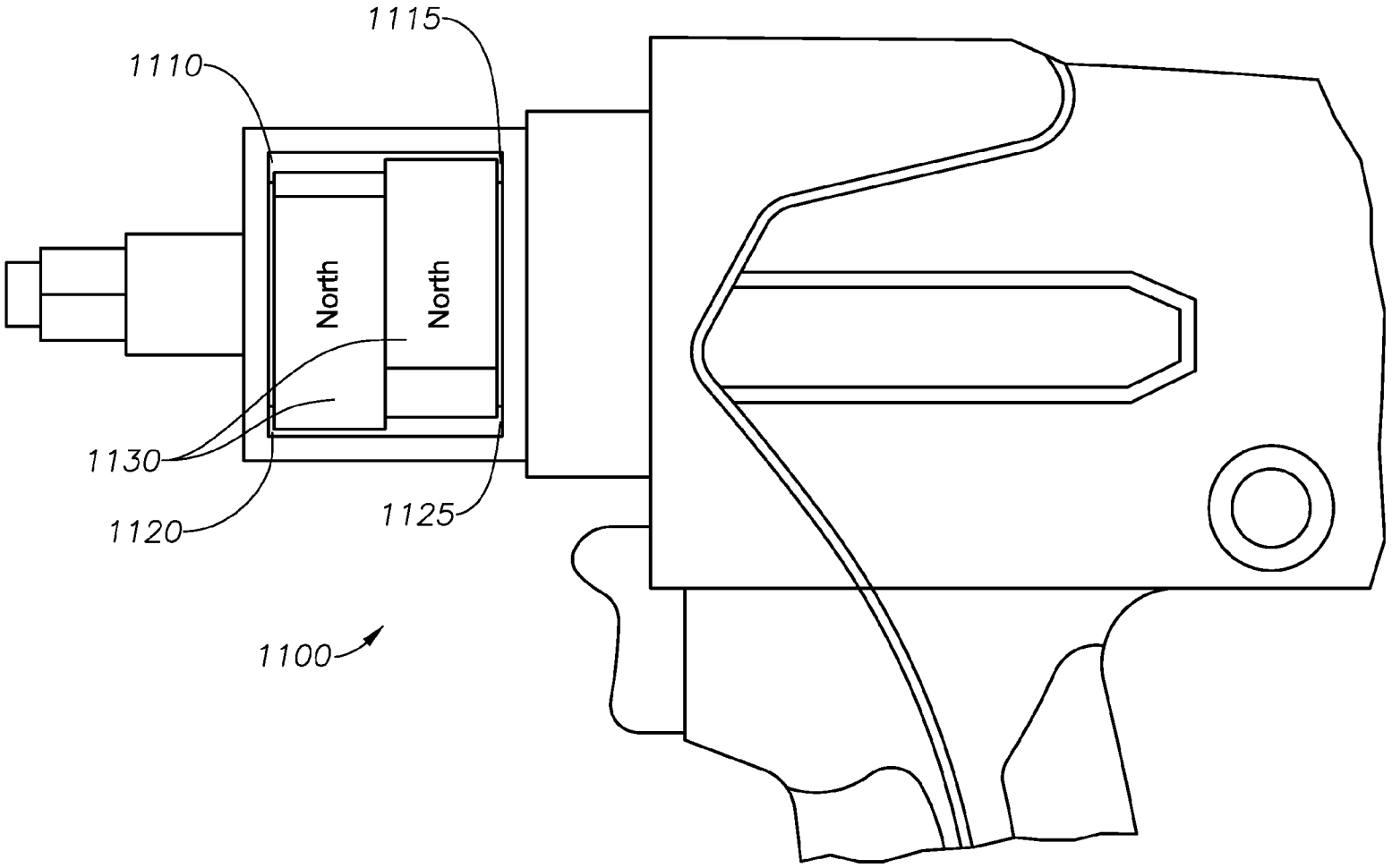
FIG. 11 illustrates a motorized tool having a hammer assembly with magnetic poles identified, according to some embodiments.
Figure 12:
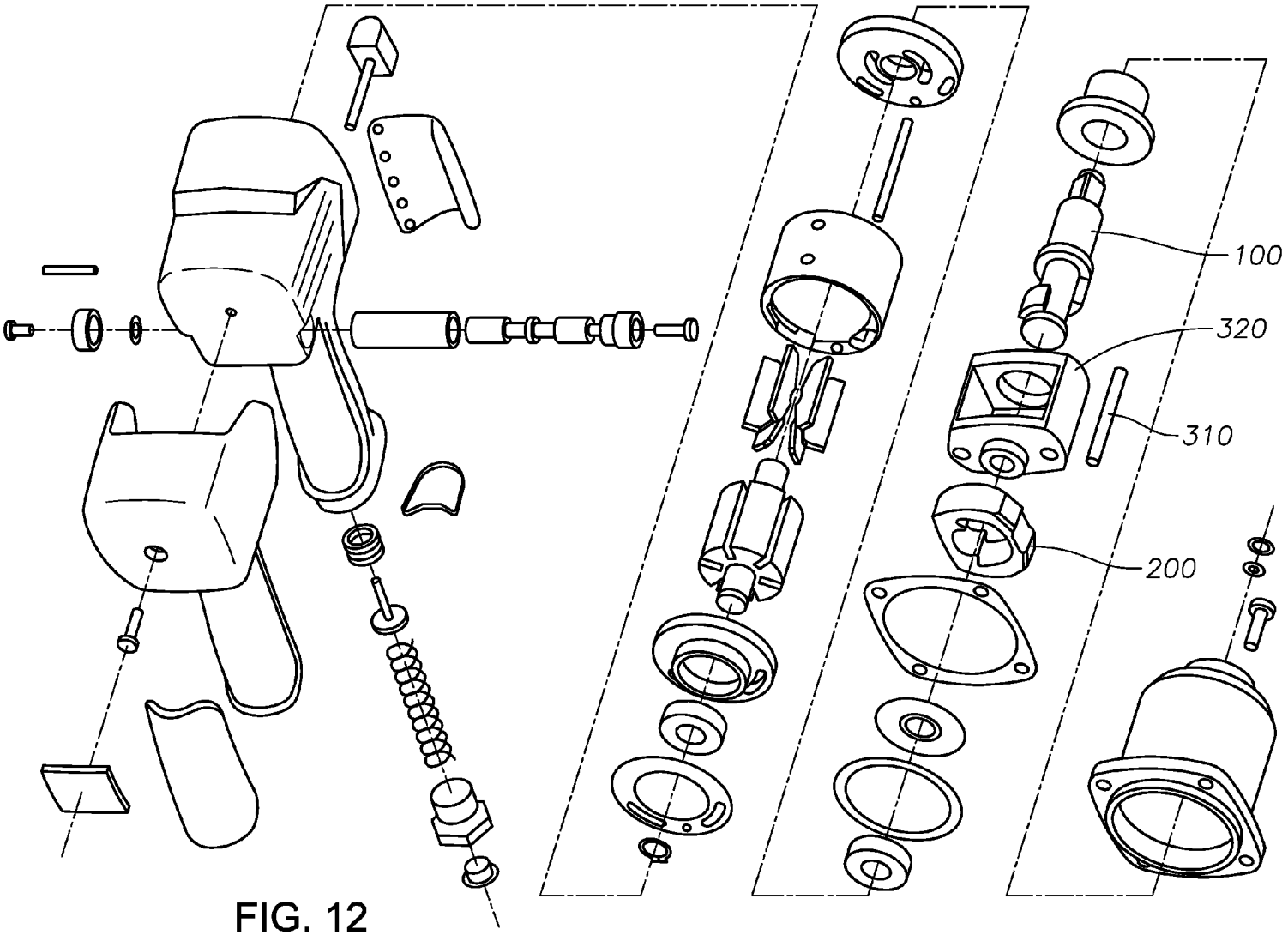
FIG. 12 is an exploded view of a motorized tool, according to some embodiments.

One example of an air tool or pneumatic tool (the terms will be used interchangeably herein) uses a rotary vane air motor to drive (rotate) a hammer assembly. Such a tool (exterior view) is shown in FIG. 11. FIG. 12 shows an exploded view of the tool showing, inter alia, interior parts not visible in FIG. 11. While this disclosure describes improvements and concepts relative to embodiments of an air tool with two hammers, one of ordinary skill in the art, given the benefit of this disclosure, will readily see that different embodiments apply equally well to electric or other motorized tools and to tools requiring a single hammer to drive in one rotational direction. For example, an ice crusher may be improved utilizing a single direction hammer assembly in accordance with disclosed embodiments.

Referring to FIG. 1, drive shaft 100 is configured with two anvils 110. The two anvils 110 or notches are at adjacent positions along the length of drive shaft 100. Anvils 110 are separated by 180 degrees about the circumference of drive shaft 100.

FIG. 2 illustrates a hammer assembly (two hammers) 200 in which a first hammer is positioned on top of a second hammer. In addition, the top hammer is positioned in an opposite (e.g., rotated 180 degrees) orientation relative to the bottom hammer. In the top hammer a pivot pin-engaging semicircular depression 205 is seen, while in the bottom hammer a longer flatter depression 210 is seen, which acts to limit range of motion of the hammer while the tool is in operation. As explained in more detail below, in operation the two hammers 200 will be positioned on drive shaft 100 within a housing/cage and caused to toggle back and forth on a pair of pins (see, e.g., FIGS. 6 and 7), with a limited range of motion. One pin of the pair serves as a pivot pin for the top hammer and to limit the range of motion of the bottom hammer, while the other pin serves as a pivot pin for the bottom hammer and to limit the range of motion of the top hammer. In FIG. 2, the portion of the pin located in the small depression 205 of the top hammer serves as a pivot pin for the top hammer, and the portion of the pin located in the longer flatter depression 210 of the bottom hammer serves to limit the range of motion of the bottom hammer. As can be seen, e.g., in FIGS. 6 and 7 (and not in FIG. 2), on the opposite side of the top hammer, a longer flatter depression 210 is provided, and on the opposite side of the bottom hammer a small depression 205 is provided. The second pin of the pair is seated in these depressions 205 and 210 in like manner and operates in like manner, with the portion of the pin located in the small depression 205 of the bottom hammer serving as a pivot pin for the bottom hammer and portion of the pin located in the longer flatter depression 210 of the top hammer serving to limit the range of motion of the top hammer.

Figure 3A:
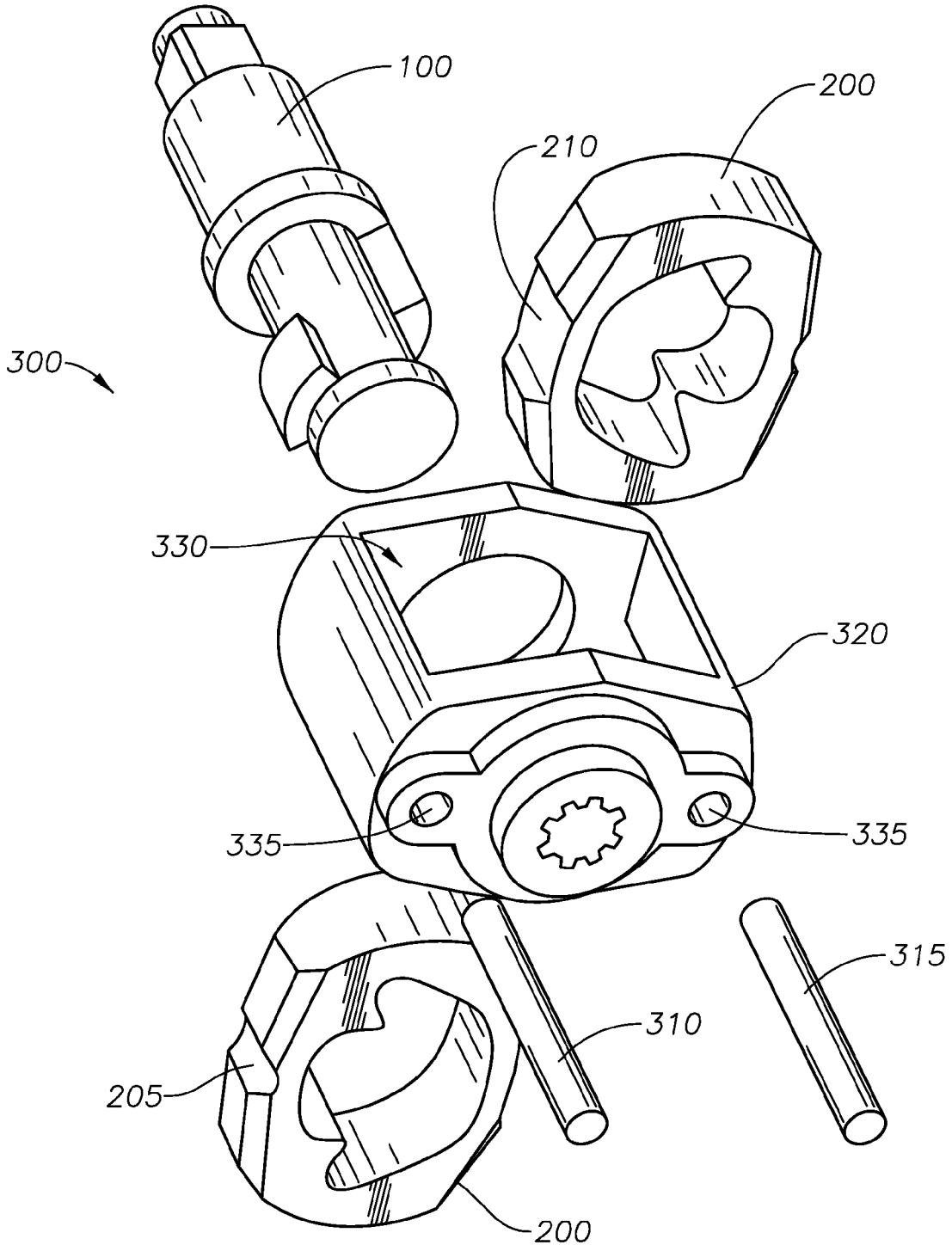
FIG. 3A is an exploded view of a casing (housing), an anvil, two hammers and two pins, according to some embodiments.
Figure 3B:
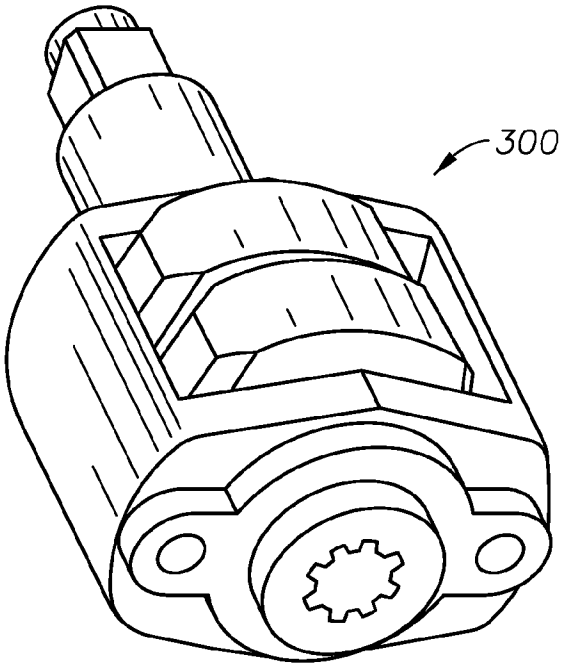
FIG. 3B is a view of the components of FIG. 3A shown in an assembled state, according to some embodiments.

FIGS. 3A and 3B illustrate exploded and assembled views, respectively, of a drive assembly 300. As seen most easily in FIG. 3A drive assembly 300 includes the following components: cage 320 or housing, two hammers 200, two pins 310 and 315, and drive shaft 100 or yoke. As shown in FIG. 3A pin 310 will be inserted through hole 335 and will serve as the pivot pin for a first hammer's (200) pivot slot 205 while also serving as a limiting pin for a second hammer's (200) longer, flatter depression 210. A second pin 315 will be inserted into a second hole 335 to perform a corresponding but reverse function for each of the hammers 200. As seen in the figures, the two pins (310 and 315) are seated adjacent—touching, engaging . . . the pin-engaging sides of the outer peripheral walls of the hammers. The two pins (310 and 315) are seated opposite each other, against opposite pin-engaging sides of the outer peripheral walls of the hammers 200. Anvil 100 will feed through opening 330 in cage 320 and through the central opening of each of hammers 200. Thus as cage 320 is rotated during operation of the hammer drill, for example, hammers 200 will alternate engaging a strike tooth and reset tooth on the anvils of drive shaft 100.

Figure 4A:
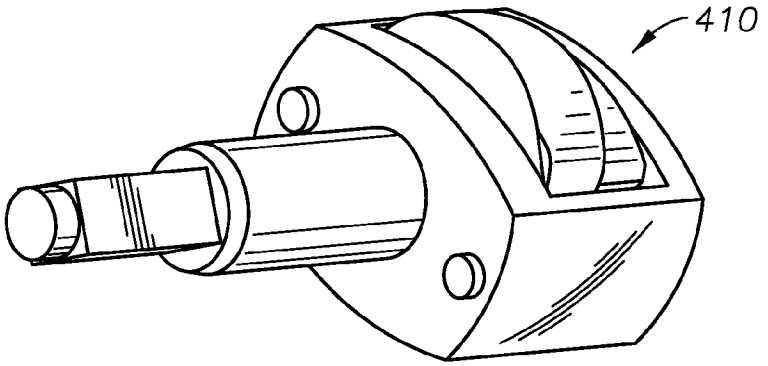
FIGS. 4A-B illustrate the "pivoting" motion of the hammers within the housing as controlled by the pins, according to some embodiments.
Figure 4B:
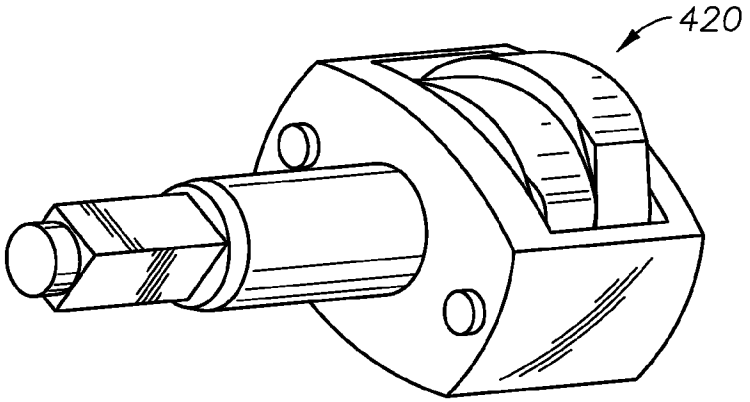

FIGS. 4A and 4B illustrate the toggle effect described above. The hammers toggle in opposite orientations from each other. Specifically, the hammers toggle between a first position 410 (FIG. 4A) and a second position 420 (FIG. 4B). In operation, the hammers will be forced to repeatedly alternate between the two positions 410, 420.

Figure 5:
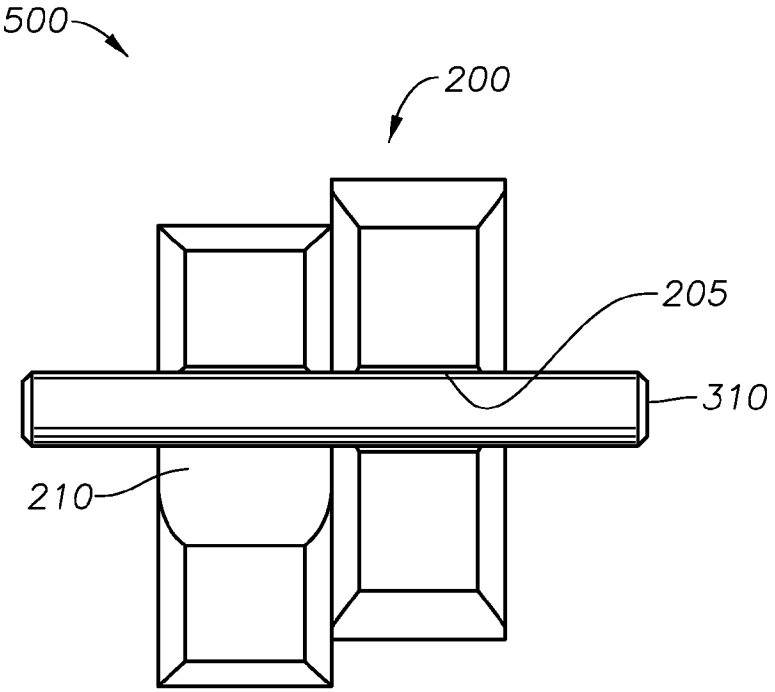
FIG. 5 illustrates the interaction of a pin with two hammers, according to some embodiments.

FIG. 5 illustrates a partial assembly 500 including a pin 310 and two hammers 200, wherein a pivot slot 205 of one hammer and a longer flatter depression 210 of the other hammer is shown. The illustrated two-hammer assembly may be referred to as a twin hammer assembly. The principles of the present disclosure may also be applied to a single hammer assembly (including a single hammer), and one of ordinary skill in the art will appreciate how to implement single hammer embodiments. The primary focus of the present discussion will be the twin hammer assembly.

Figure 6:
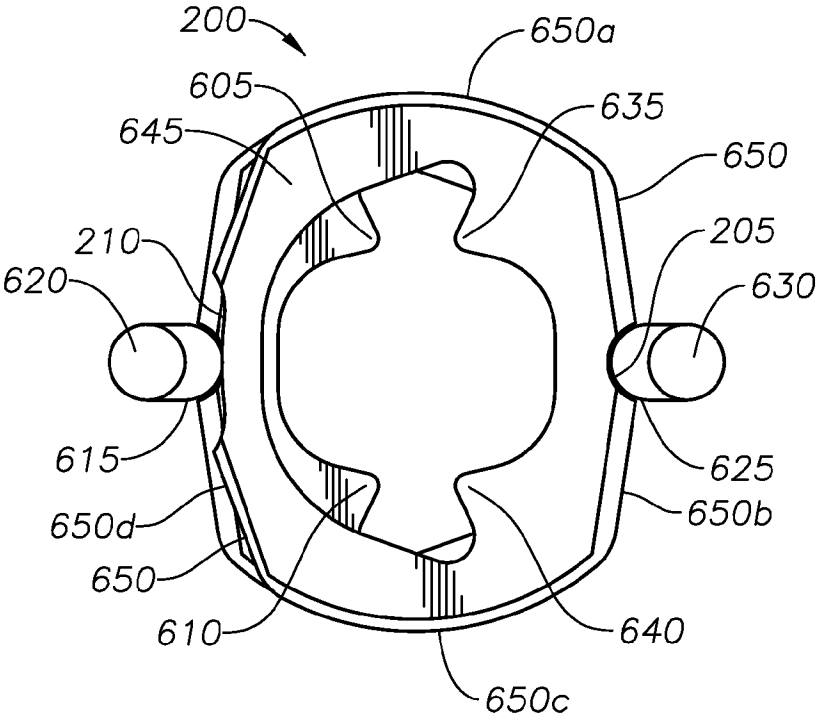
FIG. 6 illustrates a single hammer and two pins, with identification of magnetic portions, according to some embodiments.

As seen, for example, in FIGS. 2 and 6, two opposed ones of the four sides of each hammer 200 have depressions (205, 210) for engaging a pin, and hence may be designated as pin-engaging sides (650*b* and 650*d*); the other two opposed ones of the four sides do not engage pins and hence may be designated as non-pin-engaging sides (650*a* and 650*c*). As seen, for example, in FIG. 6, for any given hammer 200, one of the pin-engaging sides (650*b*) is closer to the teeth (e.g., 635, 640) than the other pin-engaging side (650*d*). One of the non-pin-engaging sides (650*a*) is closer to one tooth (635), and the other one of the non-pin-engaging sides (650*c*) is closer to the other tooth (640). At the center of the pin-engaging side 650*b* that is closer to the teeth, the outer peripheral wall includes the semicircular depression (pivot slot) 205, centered between the two teeth (640 and 635), in which one end of one of the two pins (310 and 315) is seated, to serve as a pivot about which the hammer 200 may pivot, as seen, for example, in FIG. 6. Opposite the semicircular depression 205, that is, at the center of the opposite pin-engaging side (650*d*) of the outer peripheral wall, is the longer, flatter depression 210, having a length along the outer peripheral wall (650) exceeding that of the semicircular depression 205. In this longer, flatter depression 210, one end of the other one of the two pins (310 and 315) is seated. The contrast between the semicircular depression 205 and the longer, flatter depression 210 is well seen on the top and bottom hammers 200 in FIG. 2.

Referring to FIG. 6, for a given hammer 200, there is an aperture in the central region thereof, a strike or catch tooth (610 or 640) and a reload or recoil tooth (605 or 635). Each hammer has two opposed broad faces (each broad face may be conceived of as including the aperture) (e.g., 645 for the top hammer in FIG. 6), and an outer peripheral wall (e.g., 650 for the top hammer in FIG. 6), forming sides (650*a*, 650*b*, 650*c* and 650*d* for the top hammer in FIG. 6) perpendicular to the broad faces. The outer peripheral wall 650, while not forming a rectangle, may be thought of as having four curved "sides," as shown. The strike tooth (610, 640) and reload tooth (605, 635) jut out into the aperture. The strike tooth (610, 640) has a sharper or narrower and higher profile extending into the aperture than the reload tooth (605, 635), which has a flatter, lower profile in the aperture. Given that the hammers 200 are seated in opposed orientation to one another, their respective sets of teeth are situated across the aperture from one another. In addition, the strike teeth (610, 640) of the two hammers are located closer to one non-pin-engaging side (e.g., the sides of the hammers 200 located at 650*c* in FIG. 6) of the twin hammer assembly, while the reload teeth (605, 635) of the two hammers are located closer to the other non-pin-engaging side (e.g., the sides of the hammers 200 located at 650*a* in FIG. 6) of the twin hammer assembly. As explained above, the limiting pin for a respective hammer 200 will allow the hammer to rotate a certain amount when the anvil 110 of drive shaft 100 impacts the strike tooth (610, 640). After impact the hammer 200 is referred to as being in the reload position and the reload tooth (605, 635) will then be contacted by the anvil 110 and force the hammer 200 back into strike position. To assist in the operation of reloading a hammer 200 into the strike position, this disclosure describes methods of implementing magnetic fields by magnetizing and orienting each of pins 310, 315 and hammers 200 in certain ways. In the example of FIG. 6, the pin shown at left has a north magnetic pole at its bottom 615 and a south magnetic pole at its top 620. The pin shown at right has the opposite orientation by having a south magnetic pole at its bottom 625 and a north magnetic pole at its top 630. Each hammer 200 is magnetized and oriented such that the magnetic field of each pin attracts the hammer 200 into the reload position. Thus, each hammer will always have a tendency (as caused by magnetic attraction and repulsion) to return to and remain in the pre-strike position and will not rely only on the reload tooth (610, 640) to return to the pre-strike position.

Figure 7:
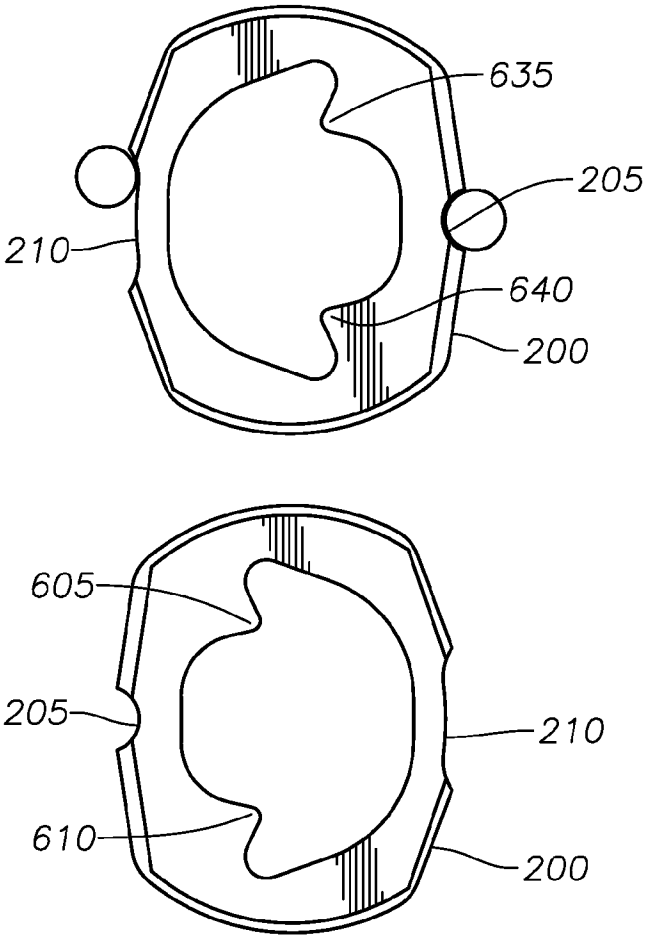
FIG. 7 illustrates two hammers in an "unstacked" (non-operational) state for the purpose of identifying certain hammer and pin attributes, according to some embodiments.

Referring to FIG. 7, two hammers 200 are illustrated in an unstacked (non-operational) position to more clearly illustrate the orientations, depressions, and teeth of the two hammers 200.

Figure 8:
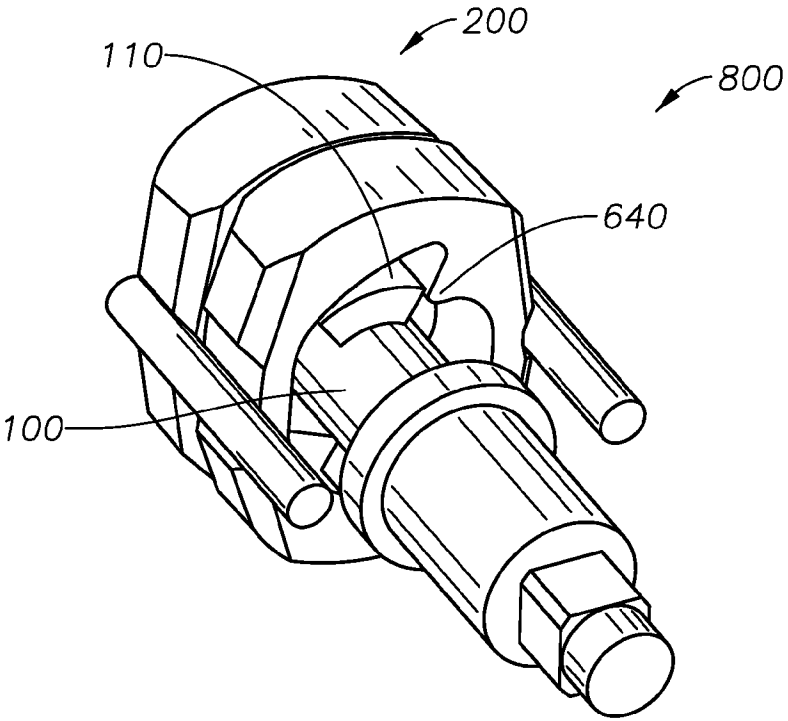
FIG. 8 illustrates a drive shaft, hammers and pins of a hammer assembly of a motorized tool, with identification of magnetic portions, according to some embodiments.

FIG. 8 illustrates an assembly 800 including the components shown in FIG. 6 but with addition of the drive shaft 100, which has anvils 110. As seen, the anvils 110 and the teeth (e.g., 640) of the hammers 200 are configured (e.g., positioned and shaped) for mutual engagement. FIG. 8 shows the upper or foreground hammer 200 in strike-ready position, and the strike tooth 640 just prior to striking the upper or foreground anvil 110.

Figure 9:
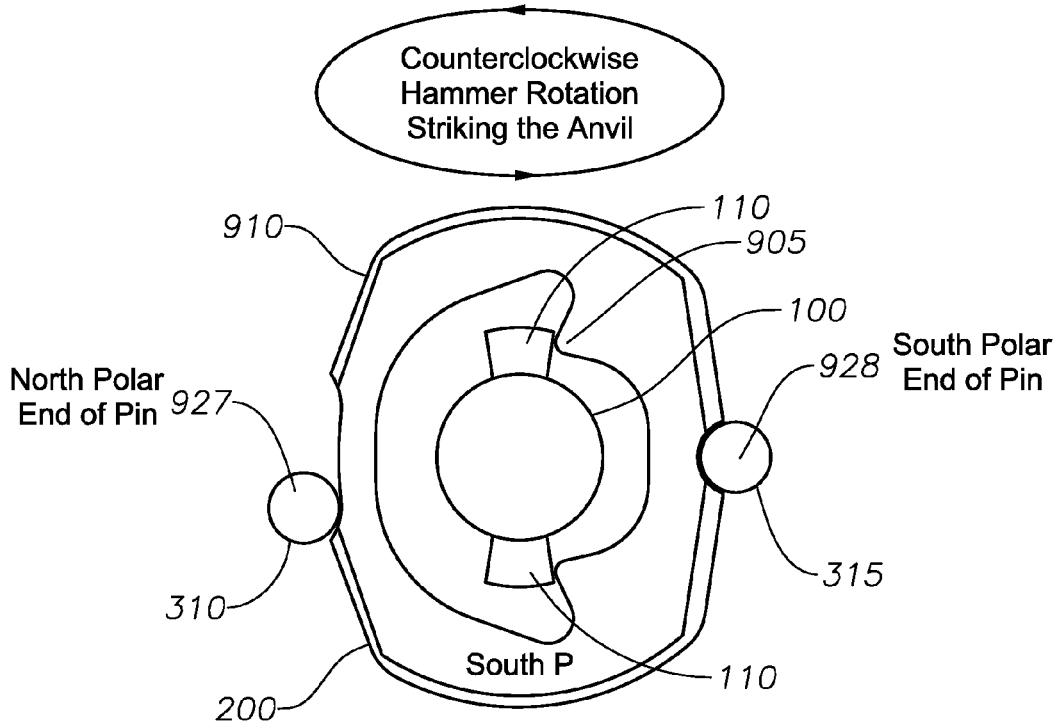
FIG. 9 is a schematic diagram illustrating hammers and pins of a hammer assembly, for the forward and reverse driving directions, and identifying the magnetic poles of the hammers and pins, according to some embodiments.
Figure 9:
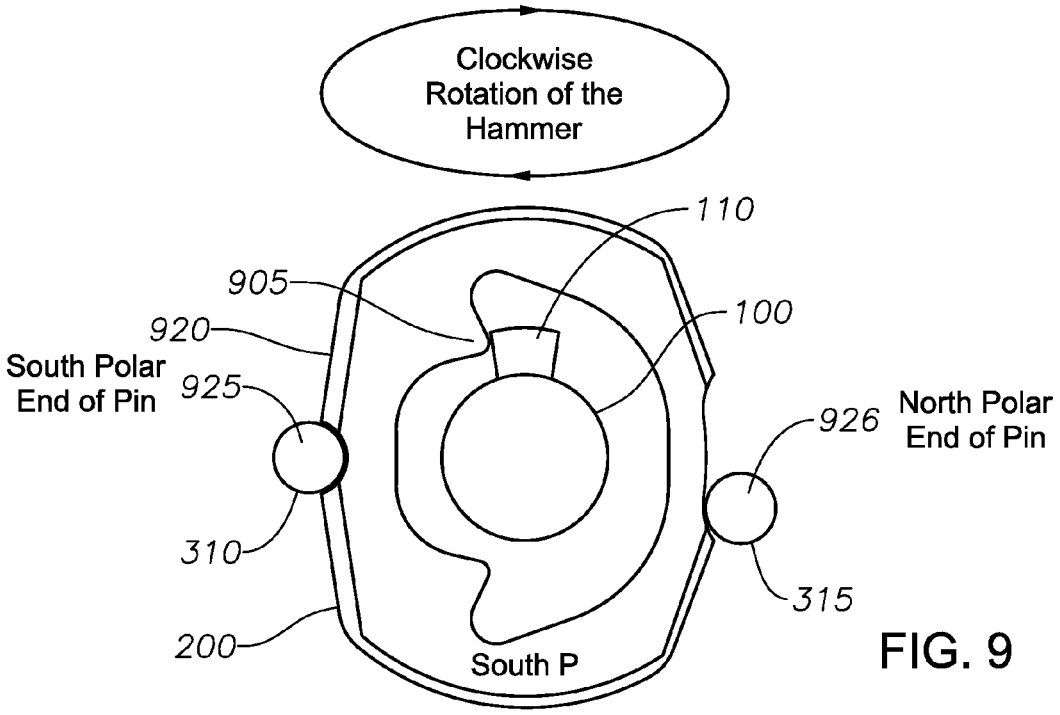

FIG. 9 is a schematic diagram illustrating the magnetic orientation of hammers 200 and pins 310, 315. Drive shaft 100 may be used to perform the action of a hammer driven mechanism in accordance embodiments of this disclosure. Such a hammer driven mechanism may be used in a power driver (e.g., impact wrench or hammer drill) having a socket for tightening of loosening a nut. When the drive shaft 100 is prevented from rotating by engagement of an attached socket with a nut (for example, in attempting to tighten or loosen a tight nut), the hammers 200 continue to rotate and the teeth of the hammers 200 will engage the anvils 110. FIG. 9 will be discussed further below.

Figure 10:
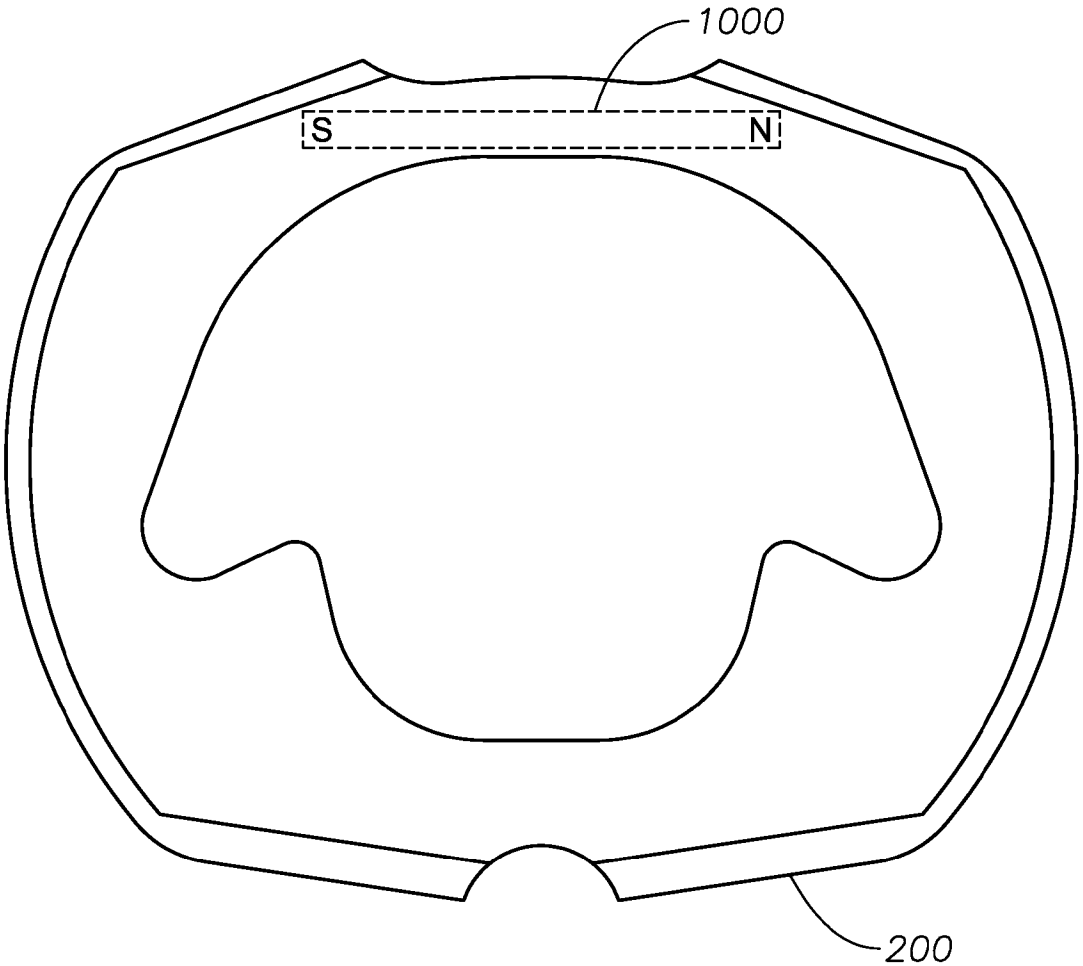
FIG. 10 illustrates a hammer including an embedded permanent magnet, according to some embodiments.

Referring now to FIG. 10, embodiments may include mechanically magnetizing components such as hammers 200 and pins 310 and 315 or may include embedding a permanent magnet such as 1000 inside the one or more hammers 200. FIG. 10 will be discussed further below.

FIG. 11 illustrates an example of an air tool 1100 shown with a portion of its housing removed to expose the disclosed hammers 1130 and magnetic poles (1110, 1115, 1120, and 1125) of pins (310, 315) in one possible operational orientation. FIG. 12 is an exploded view illustrating further components of one example air tool. FIGS. 11 and 12 will be discussed further below.

The following is a more detailed explanation of the operation of disclosed embodiments with reference to previously explained figures. When the strike tooth (610 or 640) of the hammer 200 strikes the anvil 110, the hammer 200 pivots about the pivot pin 310 (i.e., the pin serving as the pivot pin for this given hammer) and the side of the hammer 200 opposite the pivot pin 310 moves along the other (movement-limiting) pin 315 seated in the longer, flatter depression 210; the latter pin 315 serves to limit the pivoting movement of the hammer 200. That is, the hammer 200 moves the length of the longer, flatter depression 210 and is stopped by the movement-limiting pin 315, which is stopped by the endwall of the longer, flatter depression 210. Thus, before the strike tooth (610 or 640) strikes the anvil 110, the movement-limiting pin 315 is located at the endwall of the longer, flatter depression 210, that is, at one end of the longer, flatter depression 210; after the strike tooth (610 or 640) strikes the anvil 110, as stated, the hammer 200 pivots such that the side of the hammer 200 opposite the teeth moves along the movement-limiting pin 315, until the movement-limiting pin 315 is located at the other end of the longer, flatter depression 210, at which point the hammer 200 movement is stopped by the movement-limiting pin 315 hitting the other endwall of the longer, flatter depression 210, that is, at the other end of the longer, flatter depression 210.

With the striking of the strike tooth (610 or 640) by the anvil 110, torque is generated by the drive shaft 100 and transmitted to the socket (not shown), for example, to turn a nut (not shown). In addition, the movement of the hammer 200 upon the striking of the anvil 110 by the strike tooth (610 or 640) places the hammer 200 into the reload position and releases or disengages the anvil 110 and the strike tooth (610 or 640). Subsequently, the reload tooth (605 or 635) engages the anvil 110, which again causes the hammer 200 to pivot about the pivot pin 310, but in the other direction, so that the side of the hammer 200 opposite the pivot pin 310 now moves back the length of the longer, flatter depression 210, returning the hammer 200 to its previous position, namely, the strike-ready position. The engagement of the reload tooth (605 or 635) and the anvil 110 does not serve to generate significant torque for use by the tool.

As the anvils 110 are 180 degrees out of phase, when the strike tooth (610 or 640) of one hammer 200 strikes one anvil 110, the reload tooth (605 or 635) of the other hammer 200 engages the other anvil 110. Accordingly, in operation of the air tool, the hammers 200 continually move out of position with one another. This is shown in FIGS. 4A-B: the hammers 200 are continually moving between the positions 410, 420, respectively.

As seen, for example, in FIG. 6, in the air tool the two hammers 200 are positioned in opposite orientations. Thus, in the figure, one hammer appears to be upside down relative to the other. As described further below, one of the two hammers 200 serves to provide torque when the air tool is operated in the forward direction, and the other one of the two hammers 200 serves to provide torque when the air tool is operated in the reverse direction.

As seen, for example, in FIGS. 3A and 3B, the drive shaft 100 is inserted through the large circular aperture 330 of the cage 320 (shown at the right/background side of the cage 320 in FIG. 3A) and through the central apertures of the hammers 200, along the central longitudinal axis of cage 320, which is the axis of rotation of the cage 320. As may be understood from FIGS. 3A and 3B, the drive shaft 100 is rotatably connected at its proximal end (left end in FIG. 3B) to the rotor, which drives (rotates) the drive shaft 100. The distal end of drive shaft 100 extends in the other direction and includes an end portion configured for connecting a socket (not shown) to the end portion, the socket being configured to engage, for example, a nut for tightening or loosening. Cage 320 is also rotatably connected to and rotated by the rotor. Accordingly, hammers 200 and pins (310 and 315) seated in cage 320 are also rotated together with the cage. As will be described below, pins (310 and 315) are also able to rotate about their longitudinal cylindrical axis independently of the cage rotation, and each of the hammers is able to pivot about one of the pins (310 and 315) independently of the cage 320 rotation. Such a tool may function as an impact wrench, for example.

Such an air tool may be driven in a forward direction (e.g., driving the rotor, cage 320 and drive shaft 100 in a clockwise direction) or in a reverse direction (e.g., driving the rotor, cage 320 and drive shaft 100 in a counterclockwise direction). The air tool may have a switch for setting the direction of operation and switching between directions. The forward direction may be used, e.g., to tighten a lug nut, and the reverse direction may be used, e.g., to loosen a lug nut.

Returning to FIG. 9, this figure schematic illustrates the engagement of the hammer teeth (e.g., 905) and anvils 110. In FIG. 9 the two hammers (910 and 920, which are specific examples of hammers 200) are shown in an unstacked (non-operational) position, drawn next to each other on the page, rather than in a stacked, operational position, seated broad face to broad face on top of one another, as shown in FIG. 8. In FIG. 9 the two hammers (910 and 920) are meant to illustrate the different driving directions/settings (namely, forward and reverse) of the air tool.

In FIG. 9, top hammer 910 is in the strike-ready position and strike tooth 905 is about to engage or strike anvil 110. As noted in the figure, hammer 910 rotates counterclockwise, which corresponds to the reverse direction/setting of the tool. Hammer 920 illustrates the forward direction/setting of the tool, and thus is indicated as traveling in the clockwise direction. Hammer 910 serves to generate useful torque when the tool is run in the reverse direction and hammer 920 serves to generate useful torque when the tool is run in the forward direction.

The torque generated by the engagement of a strike tooth (e.g., 905) with a corresponding anvil 110 may be referred to as instantaneous torque. The torque generated over a period of time (multiple hits of a strike tooth (e.g., 905) against its corresponding anvil 110) may be referred to as accumulated torque.

In the air tool, aside from being rotated with cage 320 (not shown in FIG. 9), the hammers 200 (or 910, 920 in FIG. 9) are free to move, i.e., pivot within cage 320. Consequently, it may occur that a hammer moves out of place before or after being reloaded (before or after the reload tooth engages the anvil), such that the hammer is not in strike-ready position at the proper time (at such time as a strike tooth (e.g., 905) would otherwise strike a corresponding anvil 110). This moving out of place may occur, e.g., due to gravity (and the orientation of the tool), jiggling of the tool or the like. When the hammer 200 is not in strike-ready position at the proper time, a misfire or partial misfire may occur, e.g., the strike tooth does not properly hit the anvil. Such misfires of course may reduce the amount of torque that is generated.

According to embodiments of the present disclosure and illustrated in FIG. 9, the hammers (910 and 920) and pins (310 and 315) (as indicated by their poles 925, 926, 927, and 928) may be magnetic in such a fashion as to reduce the occurrence of misfires and partial misfires. Specifically, magnetic force may be used to assist in reloading the hammers (910 and 920), that is, putting them into strike-ready position, and in keeping hammers (910 and 920) in strike-ready position once they are reloaded. This may not only keep hammers (910 and 920) more reliably in the strike-ready position but it may also get hammers (910 and 920) in the strike-ready position more quickly than they otherwise would get into the strike-ready position. Thus, hammers (910 and 920) may be kept in strike-ready position for a greater percentage of the time that they are supposed to be in strike-ready position than would otherwise be the case. Consequently, the number of misfires may be decreased and the number of proper hits correspondingly increased. Accordingly, the air tool may be operated in a more controlled, regular or stable manner, as the hammers (910 and 920) stay in their intended locations and do not slip out of place to a great degree. In addition, this magnetic arrangement, by using magnetic force to reload hammers (910 and 920) to strike-ready position, may assist the motor, thereby permitting the motor to operate at a greater speed, or to impart more force, or operate on a reduced flow rate of compressed air, etc. The use of a magnetic force (magnetic portions of the device) to create the above improved effects is understood to be more beneficial than using a mechanical means to accomplish the same (if such were possible), as a mechanical means may be more subject to wear and breakdown.

The above use of magnetic force will now be more fully described with continued reference to FIG. 9. As illustrated, each hammer (910 and 920) has one magnetic pole on each non-pin-engaging side of the hammer (top and bottom in FIG. 9). For example, in FIG. 9, each of the two hammers (910 and 920) has a north pole on the top non-pin-engaging side and a south pole on the bottom non-pin-engaging side. Thus, if we consider that the hammers (910 and 920) are arranged as shown in FIG. 8 (i.e., stacked one on top of the other), and we view the hammers of FIG. 9 from the north pole side, the top hammer 920 would have its pivot side on the left and the bottom hammer 910 its pivot side on the right, as is shown in FIG. 8. It will also be noted that the magnetic poles in FIG. 11 are the same as those in FIG. 8.

In FIG. 9, it will be posited that when the two hammers are placed in a stacked configuration, hammer 920 is the top hammer and hammer 910 is the bottom hammer. Thus, in FIG. 9, the left pin has a south pole 925 at the top (or adjacent the top hammer 920 pivot point) and a north pole 927 at the bottom (or adjacent the bottom hammer limit region), while the right pin has its poles (926 and 928) reversed from those (925 and 927) of the left pin. In FIG. 9, since we are effectively discussing the assembly from the perspective of the south faces of the hammers rather than the north faces shown in FIG. 11, the poles of the pins in FIG. 9 are reversed from the configuration shown in FIG. 11: in FIG. 11 the pin shown at the top of the tool has north 1110 on its left and south 1115 on its right, and the pin shown at the bottom of the tool has south 1120 on its left and north 1125 on its right.

With this magnetization of the hammers and pins and continuing our discussion using the reference numbers of FIG. 9, let us consider what occurs when the strike tooth 905 of hammer 910 strikes the anvil 110 and the hammer 910 pivots about its pivot pin 315 so as to move at the side of its movement-limiting pin 310. As stated, hammer 910 will move relative to the movement-limiting pin 310 such that the movement-limiting pin 310 effectively moves from one end to the other end of the longer, flatter depression of hammer 910. Given the above arrangement of magnetic poles, when the movement-limiting pin 310 effectively moves to the other end of the longer, flatter depression, it also effectively moves from one pole to the other pole of the hammer 910. Specifically, the movement-limiting pin 310 effectively moves from a pole to which it is attracted to a pole from which it is repelled. Consequently, once the hammer 910 has been moved to the already struck position, that is, once the movement-limiting pin 310 has effectively moved to the other end of the longer, flatter depression, the movement-limiting pin is magnetically repelled by the hammer pole at that end of the longer, flatter depression, and magnetically attracted back to the first end of the longer, flatter depression, the end where it was positioned before the strike tooth 905 struck the anvil 110. As the movement-limiting pin 310 magnetically attracts hammer 910 back to that end, it assists hammer 910 to return to the pre-strike position.

In addition to the magnetization of the pins (310 and 315) and hammers (910 and 920) working to return and keep the hammers (910 and 920) to/in strike-ready position, the magnetization of the hammers (910 and 920) also serves to reduce friction between the two hammers (910 and 920). Without the magnetization of the hammers (910 and 920), considerable friction may be generated between the two hammers (910 and 920), because they are two metal pieces seated with their broad faces facing one another and they are moving or sliding across or past one another due to the continual hitting and reloading (see FIGS. 4A and 4B). By magnetizing the hammers (910 and 920) as illustrated in FIG. 9 with like polar sides next to each other when in cage 320, hammers (910 and 920) are magnetically repelled from one another at their broad faces where they face each other. As seen, for example, in FIG. 11, hammers 1130 are positioned such that their north poles face each other and their south poles face each other. Due to this magnetic repelling, a small gap may be created between the facing broad faces of the hammers 1130, which gap would not exist without the magnetization of the hammers 1130. Consequently, friction between the facing broad faces of the hammers 1130 may be reduced and the hammers 1130 may move across or past one another more freely. As a result of this magnetic "assist," the motor of the air tool 1100 may work at a greater speed (RPMs), which would increase the number of attempted hits (striking of the anvil 110 by the strike tooth (e.g., 905)) per unit time. As discussed above, the percentage of attempted hits which is successful is increased by the operation of the magnetized poles of pins (1110, 1115, 1120, and 1115) and hammers 1130. As shown in FIG. 11, the pin shown at the top of the tool has a magnetic north pole 1110 and a magnetic south pole 1115 while the pin shown at the bottom of the tool has a magnetic north pole 1125 and a magnetic south pole 1120 oriented at 180 degrees from the poles of the top pin. Again, as a result of this magnetic "assist," the motor of air tool 1100 may impart a greater force with each hit, thereby increasing the useful torque generated. Again, as a result of this magnetic "assist," the motor of air tool 1100 may require a lower air flow rate (cfm) to operate with the same force and/or RPM, such that a user may be able to use air tool 1100 with a smaller air compressor. Thus, the increased efficiency of the arrangements discussed above may permit the same torque and power to be achieved with significantly less air pressure. Consequently, smaller, less expensive compressors may be used with air tools having these designs.

The instant inventors have noted that the temperature of the air tool may be significantly lower when using the magnetized hammers 200 than without them. This reduction of temperature is understood to be a measure of the reduction of friction achieved by the magnetic repulsion between hammers (e.g., 200 or 1130).

The instant inventors have measured various improvements in air tools (e.g., 1100) having the above-described magnetic arrangements/aspects as compared to without these magnetic arrangements/aspects. For example, air tools (e.g., 1100) having the above-described magnetic arrangements/aspects have demonstrated significant increases in motor (rotor) speed (rpm), number of hits/minute, instantaneous torque, and accumulated torque, in addition to the above-noted reduction of friction as reflected by lower tool temperature. Some of these improvements are tabulated as shown in Table 1 below.

TABLE 1

| Instant Torque | Stock 3/8 | Magnetic 3/8 | Increase in power vs. Stock |
|---|---|---|---|
| Low | 50 | 108 | 53.7% |
| Med | 85 | 145 | 41.4% |

TABLE 1-continued

| Instant Torque | Stock 3/8 | Magnetic 3/8 | Increase in power vs. Stock |
|---|---|---|---|
| High | 105 | 157 | 33.1% |
| Accumulated torque at 30 seconds | 170 | 310 | 45.2% |
| RPM | 8800 | 10000 | 12% |

The magnetic arrangements described herein are not limited as to the types of magnetic materials that may be used to create or render magnetic the hammers and/or pins. For example, the hammers 200 and/or pins (e.g., 310, 315), or parts thereof, may be formed of any suitable material in which magnetism may be induced by application (by hand or machine) of an external magnetic field. Such materials include iron, steel, alloys of those, nickel, and other materials. In this case, an appropriate material used for the housing of the air tool 1100 (e.g., aluminum) may serve to foster retention of the induced magnetism. As another example, the hammers 200 and/or pins (e.g., 310), or parts thereof, may be formed of or include permanent magnets. An example of this is shown in FIG. 10, where a hammer 200 has an embedded permanent magnet 1000 having north and south poles at the two non-pin-engaging faces, or at the two ends of the longer, flatter depression, respectively, so that the movement-limiting pin is attracted to the pre-strike position and repelled from the post-strike position, as described above. In addition, in the case of using embedded permanent magnets, each of the two hammers (e.g., 200) may have one or more embedded permanent magnets, with the poles of the magnets in the two hammers being located in positions such that when the hammers are in their operational position in an assembled air tool the two hammers (e.g., 200) repel each other to reduce friction between them, as described above. As an example, the locations of the north and south poles of the embedded permanent magnets 1000 could be shifted from that shown in FIG. 10: the north and south poles could be located closer to (e.g., could be located at or near) the centers of the non-pin-engaging sides of the hammers.

As far as the magnetic strength of the hammers (e.g., 200) and pins (e.g., 310 and 315), significant improvements of the type described above have been found where each hammer 200 has a magnetic strength able to lift its own weight and each pin (e.g., 310, 315) has a magnetic strength able to lift three times its own weight (e.g., if two hammers 200 are placed next to each other with opposite poles facing each other so that the two hammers 200 attract one another rather than repel one another as in the above-described embodiments, then if a hammer 200 has a magnetic strength able to lift its own weight, it could hold the other hammer 200 up against the force of gravity).

It is possible to have only the hammers 200 or only the pins (e.g., 310, 315) be magnetic, but this may reduce the positive effects described above. In addition, in the case where the hammers 200 and pins (e.g., 310, 315) are magnetized by inducing magnetism in them rather than by including permanent magnets in them, it is understood that the induced magnetism may last longer if both hammers 200 and pins (e.g., 310, 315) are magnetized rather than just one of the hammers 200 and the pins (e.g., one of 310 and 315). Where only one of the hammers 200 and the pins (e.g., one of 310 and 315) is magnetized, the metal of the non-magnetized components may tend to drain the magnetization of the magnetized components.

Figure 13:
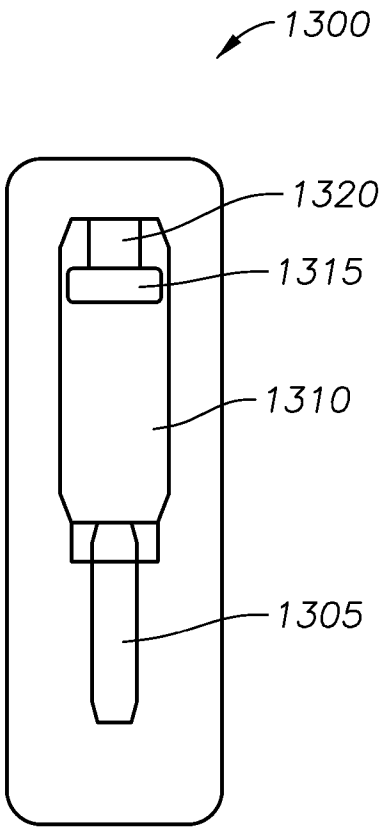
FIG. 13 illustrates a magnetically assisted piston assembly that could be used, e.g., in a stapler or nail gun, according to some embodiments.

Referring now to FIG. 13, in addition to air tools such as those having a rotary motor to drive a hammer assembly, the principles set forth above are applicable to other air tools. One example of such would be a tool driven with a piston mechanism 1300 for use, for example, in nail guns or staple guns. FIG. 13 shows such piston mechanism 1300 for such a tool (e.g., nail gun) with magnetic portions 1320 and 1315. As shown in FIG. 13, a first magnetic portion 1315 may be provided in the driver plunger 1310 or piston and a second magnetic portion 1320 may be provided inside (as in FIG. 13) or alternatively above the piston mechanism 1300 of the tool above the driver plunger 1310. The magnetic portions 1315 and 1320 may be arranged such that they repel each other at the location where the top of the driver plunger 1310 meets the portion of the tool above it. For example, a first south magnetic pole may be provided at the top of the driver plunger 1310 and a second south magnetic pole may be provided in the portion of the tool above the driver plunger 1310, adjacent the first south magnetic pole. In this way, a repelling magnetic force is established at the top of the driver plunger 1310, assisting in forcing the driver plunger 1310 downward, to achieve increased force (in driving the nail, etc.), or require less force from the air motor, or a reduced flow rate of compressed air, etc. as described above with respect to the air motors having a hammer assembly (e.g., FIG. 3B). A similar repelling magnetic force could be arranged using magnetic portions at the bottom of the tool, e.g., to serve as a cushion, which may help prevent wear on the tool, reload the driver, etc. In FIG. 13, the driver plunger 1310 is in the driven position (note that driver 1305 is extended) and has not yet been returned to strike-ready position.

It is noted that reference may be made in the instant application to what are understood to be reasons underlying improved performance of the present invention with respect to problems present in the prior art. While statements of such reasons represent the inventors' beliefs based on their scientific understanding and experimentation, the inventors nonetheless do not wish to be bound by theory.

It will be understood by one of ordinary skill in the art that in general any subset or all of the various embodiments and inventive features described herein may be combined, notwithstanding the fact that the description and/or claims set forth only a limited number of such combinations.

This disclosure describes various benefits and advantages that may be provided by various embodiments. One, some, all, or different benefits or advantages may be provided by different embodiments. This disclosure also describes various applications that may be provided by various embodiments. As will be understood by one of ordinary skill in the art, different applications, even if described with respect to only one or more particular embodiments or arrangements, may nonetheless be employed in other embodiments and arrangements even though this is not explicitly mentioned. Further, not all applications of the instant disclosure have necessarily been included herein, and one of ordinary skill in the art will readily appreciate that the disclosure may lend itself to other applications.

In view of the wide variety of useful permutations that may be readily derived from the example embodiments described herein, this detailed description is intended to be illustrative only and should not be taken as limiting the scope of the invention. What is claimed as the invention, therefore, are all implementations that come within the scope of the following claims and all equivalents to such implementations.

What is claimed is:

1. A hammer assembly for a motorized tool, comprising:

a cage configured to be rotatingly driven by a rotor of the motorized tool;

a first hammer pivotally seated in the cage, the first hammer comprising a first center aperture, a first strike tooth, and a first reload tooth;

a first pin and a second pin both seated in the cage, the first pin configured to serve as a pivot about which the first hammer pivots and the second pin comprising a first portion configured to limit motion of the first hammer; and a drive shaft extending through the first center aperture of the first hammer and configured to be rotatingly driven by the rotor of the motorized tool, the drive shaft including a first anvil configured for being struck by the first strike tooth upon forward rotation of the rotor;

wherein the first hammer and the second pin comprise a magnetic material, a south magnetic pole, and a north magnetic pole, wherein the first hammer and the second pin are seated in the cage such that the north magnetic pole of the second pin lies at the first portion of the second pin, such that, after the first anvil is struck by the first strike tooth the first portion of the second pin lies adjacent the north magnetic pole of the first hammer and away from the south magnetic pole of the first hammer to magnetically assist the first hammer returning to a pre-strike condition.

2. The hammer assembly of claim 1, wherein the north magnetic pole and the south magnetic pole of the second pin are induced by the magnetic material of the first hammer.

3. The hammer assembly of claim 1, wherein the first anvil is further configured for being struck by the first reload tooth after the first anvil is struck by the first strike tooth to assist the first hammer returning to the pre-strike condition.

4. The hammer assembly of claim 1, wherein the motorized tool utilizes air pressure to drive a motor to rotatingly drive the rotor.

5. The hammer assembly of claim 1, wherein the motorized tool utilizes electricity to drive a motor to rotatingly drive the rotor.

6. The hammer assembly of claim 1, wherein the magnetic material of the first hammer comprises a permanent magnet embedded within the first hammer.

7. The hammer assembly of claim 1, wherein the second pin comprises a permanent magnet to create the north magnetic pole and the south magnetic pole of the second pin.

8. The hammer assembly of claim 1, further comprising:

a second hammer pivotally seated in the cage adjacent to the first hammer, the second hammer having a second center aperture, a second strike tooth, and a second reload tooth, wherein:

the second pin is configured to serve as a pivot about which the second hammer pivots, the first pin comprises a second portion configured to limit motion of the second hammer, the drive shaft extends through the second center aperture of the second hammer and includes a second anvil configured for being struck by the second strike tooth upon backward rotation of the rotor, the first pin comprises a magnetic material positioned within the cage, such that the first and second pin have substantially opposite magnetic orientations relative to each other, the first and second hammer positioned within the cage so as to repel each other magnetically, and the first pin magnetically assists the second hammer returning to a pre-strike condition after the second anvil is struck by the second strike tooth.

9. The hammer assembly of claim 8, wherein the second pin comprises a permanent magnet to create the north magnetic pole and the south magnetic pole of the second pin.

10. The hammer assembly of claim 8, wherein the magnetic material of the second hammer comprises a permanent magnet embedded within the second hammer.

11. The hammer assembly of claim 8, wherein the second anvil is further configured for being struck by the second reload tooth after the second anvil is struck by the second strike tooth to assist the second hammer returning to the pre-strike condition.

12. The hammer assembly of claim 8, wherein the motorized tool utilizes air pressure to drive a motor to rotatingly drive the rotor.

13. The hammer assembly of claim 8, wherein the motorized tool utilizes electricity to drive a motor to rotatingly drive the rotor.

14. The hammer assembly of claim 8, further comprising a lubricant disposed on at least one face of the first hammer and at least one face the second hammer.

15. The hammer assembly of claim 14, wherein the at least one face of the first hammer is adjacent the at least one face of the second hammer.

16. A twin hammer assembly for a motorized tool, comprising:

a cage configured to be rotatingly driven by a rotor of the motorized tool;

a first hammer and a second hammer both pivotally seated in the cage, each of the first and second hammers comprising an aperture, a strike tooth and a reload tooth;

a first pin and a second pin both rotatably seated in the cage, the first pin comprising a first end configured to serve as a pivot about which the first hammer pivots and a second end configured to limit motion of the second hammer, and the second pin comprising a first end configured to serve as a pivot about which the second hammer pivots and a second end configured to limit motion of the first hammer; and a drive shaft extending through the cage and through apertures of the first and second hammers and configured to be rotatingly driven by the rotor of the motorized tool, the drive shaft including a first anvil configured for being struck by the strike tooth of the first hammer upon forward rotation of the rotor and a second anvil configured for being struck by the strike tooth of the second hammer upon reverse rotation of the rotor;

wherein each of the hammers and each of the pins comprise a magnetic material, a south magnetic pole and a north magnetic pole, wherein the hammers are seated such that the south magnetic pole of the first hammer lies adjacent the south magnetic pole of the second hammer and the north magnetic pole of the first hammer lies adjacent the north magnetic pole of the second hammer, and wherein the first and second pins are seated such that (1) the north magnetic pole of the first pin lies along a first pin portion of the first pin, such that, after the second anvil is struck by the strike tooth of the second hammer, the north magnetic pole of the first pin lies adjacent the north magnetic pole of the second hammer and away from the south magnetic pole of the second hammer, whereby the north magnetic pole of the first pin is repelled away from the north magnetic pole of the second hammer and attracted toward the south magnetic pole of the second hammer, promoting return of the second hammer to a pre-strike position, and (2) the north magnetic pole of the second pin lies along a second pin portion of the second pin such that, after the first anvil is struck by the strike tooth of the first hammer, the north magnetic pole of the second pin lies adjacent the north magnetic pole of the first hammer and away from the south magnetic pole of the first hammer, whereby the north magnetic pole of the second pin is repelled away from the north magnetic pole of the first hammer and attracted toward the south magnetic pole of the first hammer, promoting return of the first hammer to a pre-strike position.

17. The motorized tool of claim 16, wherein the motorized tool utilizes air pressure to drive a motor to rotatingly drive the rotor.

18. The motorized tool of claim 16, wherein the motorized tool utilizes electricity to drive a motor to rotatingly drive the rotor.

19. The motorized tool of claim 16, wherein at least one of the first pin, the second pin, the first hammer or the second hammer comprise a permanent magnetic material.

* * * * *